US005849109A

United States Patent [19]

Ikeda

[11] Patent Number: 5,849,109

[45] Date of Patent: Dec. 15, 1998

[54] METHODS OF PRODUCING RARE EARTH ALLOY MAGNET POWDER WITH SUPERIOR MAGNETIC ANISOTROPY

[75] Inventor: Hiroshi Ikeda, Edinburg, Pa.

[73] Assignee: Mitsubishi Materials Corporation, Tokyo, Japan

[21] Appl. No.: 814,537

[22] Filed: Mar. 10, 1997

[51] Int. Cl.[6] ..... H01F 1/057

[52] U.S. Cl. ..... 148/122; 148/101; 148/104

[58] Field of Search ..... 148/101, 102, 148/103, 104, 105, 122

[56] References Cited

U.S. PATENT DOCUMENTS

| | | | |
|---|---|---|---|
| 4,597,938 | 7/1986 | Matsuura et al. | 419/23 |
| 5,110,374 | 5/1992 | Takeshita et al. | 148/101 |
| 5,352,301 | 10/1994 | Panchanathan et al. | 148/101 |
| 5,595,608 | 1/1997 | Takebuchi et al. | 148/104 |
| 5,641,363 | 6/1997 | Fukuno et al. | 148/104 |

FOREIGN PATENT DOCUMENTS

| | | |
|---|---|---|
| 59-222564 A | 12/1984 | Japan . |
| 60-012707 | 1/1985 | Japan . |
| 60-014407 | 1/1985 | Japan . |
| 3-129702 A | 6/1991 | Japan . |
| 3-129703 A | 6/1991 | Japan . |
| 4-133406 A | 5/1992 | Japan . |
| 4-133407 A | 5/1992 | Japan . |

*Primary Examiner*—John Sheehan

*Attorney, Agent, or Firm*—Armstrong, Westerman, Hattori, McLeland & Naughton

[57] ABSTRACT

Methods of producing a rare earth alloy magnet powder having superior magnetic anisotropy and an aggregate of fine recrystallized structure of a $R_2T_{14}M$ type intermetallic compound phase. In the methods, a R—T—M—A—Mg alloy material containing Mg is subjected to the following steps: elevating the temperature of the R—T—M—A—Mg alloy material from room temperature to a temperature up to 500° C. in a vacuum or inert gas atmosphere; hydrogen-occluding treatment in which hydrogen is occluded in the R≦T—M—A—Mg alloy material to promote phase transformation by elevating the temperature from room temperature to a predetermined temperature ranging from 500° to 1,000° C. and maintaining the elevated temperature under a hydrogen atmosphere or a mixed gas atmosphere of hydrogen and an inert gas; subsequently dehydrogenating treatment in which hydrogen is forcibly released from the R—T—M—A—Mg alloy material to promote phase transformation by maintaining the R—T—M—A—Mg alloy material at a predetermined temperature ranging from 500° to 1000° C. in a vacuum atmosphere of less than 1 Torr; cooling; and crushing.

11 Claims, No Drawings

METHODS OF PRODUCING RARE EARTH ALLOY MAGNET POWDER WITH SUPERIOR MAGNETIC ANISOTROPY

The present invention relates to a method of producing a rare earth alloy magnet powder with superior magnetic anisotropy.

A known method of producing a rare earth alloy magnet powder as disclosed in Japanese Unexamined Patent Publication (Tokkaihei) No. 2-4901 comprises the successive steps of: subjecting or not subjecting an alloy material (hereinafter this alloy will be referred to as R—T—M—A alloy) to homogenization treatment in which the alloy material is maintained at a temperature ranging from 600° to 1,200° C. in an Ar gas atmosphere, which alloy material contains at least one rare earth element (which will be hereinafter represented by "R") inclusive of Y, a component (which will be hereinafter represented by "T") composed of Fe that may be not substituted or partially substituted with Co or Ni, and a component (which will be hereinafter represented by "M") composed of B that may be not substituted or partially substituted with C as a main component and further contains 0.001 to 5.0 atomic % of one or more elements (which will be hereinafter represented by "A") selected from the group consisting of Si, Ga, Zr, Nb, Mo, Hf, Ta, W, Al, Ti, and V; subjecting the R—T—M—A alloy material to hydrogen-occluding treatment in which the temperature of the alloy material is elevated from room temperature to a temperature ranging from 500° to 1,000° C. and maintained at the elevated temperature in a $H_2$ gas atmosphere or a mixed atmosphere of $H_2$ gas and an inert gas; subsequently subjecting the alloy material to dehydrogenating treatment in which the alloy material is maintained at a temperature ranging from 500° to 1,000° C. in a vacuum; cooling; and crushing the alloy material to obtain a rare earth alloy magnet powder.

Recently, in the electric and electronic fields, a rare earth alloy magnet powder has been required which has superior magnetic anisotropy as compared with conventional powders ones so as to achieve smaller size and higher performance in magnet parts. However, a rare earth alloy magnet powder which has sufficient magnetic anisotropy has not yet been obtained.

SUMMARY OF THE INVENTION

Accordingly, the inventors of the present invention have investigated to develop a method of producing a rare earth alloy magnet powder alloy having more superior magnetic anisotropy as compared with conventional powders and obtained the following findings:

(a) A rare earth alloy magnet powder alloy which has superior magnetic anisotropy and an aggregate of fine recrystallized structure of a $R_2T_{14}M$ type intermetallic compound phase can be produced such that an alloy [hereinafter an alloy prepared by addition of not more than 0.1 atomic % of Mg (exclusive of 0) to a conventional R—T—M—A alloy as previously defined will be referred to as a R—T—M—A—Mg alloy material] prepared by addition of not more than 0.1 atomic % of Mg (exclusive of 0) to a conventional R—T—M—A alloy was used as a material; subjected to hydrogen-occluding treatment in which phase transformation of the R—T—M—A—Mg alloy material is promoted by elevating the temperature of the R—T—M—A—Mg alloy material from room temperature to a predetermined temperature ranging from 500° to 1,000° C. and maintaining the elevated temperature under a hydrogen atmosphere or a mixed gas atmosphere of hydrogen and an inert gas; and subjected to dehydrogenating treatment in which the hydrogen is forcibly released from the R—T—M—A—Mg alloy material to promote phase transformation by maintaining the material at a predetermined temperature ranging from 500° to 1,000° C. in a vacuum atmosphere of not more than 1 Torr.

(b) A rare earth alloy magnet powder alloy which has superior magnetic anisotropy and an aggregate of fine recrystallized structure of a $R_2T_{14}M$ type intermetallic compound phase can be produced such that: the temperature of an R—T—M—A alloy material is elevated from room temperature to 500° C. or maintained at the elevated temperature after temperature elevation in a vacuum or an inert gas atmosphere; subjected to hydrogen-occluding treatment in which hydrogen is occluded in the R—T—M—A—Mg alloy material to promote phase transformation by elevating the temperature of the R—T—M—A—Mg alloy material from room temperature to a predetermined temperature ranging from 500° to 1,000° C. and maintaining the elevated temperature under a hydrogen atmosphere or a mixed gas atmosphere of hydrogen and an inert gas; and subsequently subjected to dehydrogenating treatment in which hydrogen is forcibly released from the R—T—M—A—Mg alloy material to promote phase transformation by maintaining the material at a predetermined temperature ranging from 500° to 1,000° C. in a vacuum atmosphere of not more than 1 Torr.

(c) The hydrogen-occluding treatment in which hydrogen is occluded in the R—T—M—A—Mg alloy material to promote phase transformation by elevating the temperature of the R—T—M—A—Mg alloy material to a predetermined temperature ranging from 500° to 1,000° C. and maintaining the elevated temperature can be conducted in a hydrogen atmosphere at 1/76 to 5 atm or a mixed gas atmosphere of hydrogen at a partial pressure of 1/76 to 5 atm and an inert gas.

(d) It is furthermore preferable to use a R—T—M—A—Mg alloy material, which has been homogenized by being maintained at 600° to 1.200° C. in a vacuum or Ar atmosphere, as the R—T—M—A—Mg alloy material.

(e) It is furthermore preferable that the R—T—M—A—Mg alloy material contains 0.001 to 0.03 atomic % of Mg.

(f) It is furthermore preferable that the R—T—M—A—Mg alloy material contains 0.001 to 0.03 atomic % of Mg and 0.001 to 1.0 atomic % of A.

The present invention was achieved-based on the foregoing findings, and is characterized by the following methods:

(1) A method of producing a rare earth alloy magnet powder, which has superior magnetic anisotropy and an aggregate of fine recrystallized structure of a $R_2T_{14}M$ type intermetallic compound phase, having the steps of:

subjecting a R—T—M—A—Mg alloy material to hydrogen-occluding treatment in which hydrogen is occluded in the R—T—M—A—Mg alloy material to promote phase transformation by elevating the temperature of the R—T—M—A—Mg alloy material from room temperature to a predetermined temperature ranging from 500° to 1,000° C. and maintaining the elevated temperature under a hydrogen atmosphere or a mixed gas atmosphere of hydrogen and an inert gas;

subsequently subjecting the R—T—M—A—Mg alloy material to dehydrogenating treatment in which hydrogen is forcibly released from the alloy material to promote phase transformation by maintaining the material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(2) A method of producing a rare earth alloy magnet powder, which has superior magnetic anisotropy and an aggregate of fine recrystallized structure of a $R_2T_{14}M$ type intermetallic compound phase, having the steps of:

elevating the temperature of a R—T—M—A—Mg alloy material from room temperature to 500° C. or maintaining the elevated temperature after temperature elevation in a vacuum or an inert gas atmosphere; subjecting the R—T—M—A—Mg alloy material to hydrogen-occluding treatment in which hydrogen is occluded in the R—T—M—A—Mg alloy material to promote phase transformation by elevating the temperature of the alloy material from room temperature to a predetermined temperature ranging from 500° to 1,000° C. and maintaining the elevated temperature under a hydrogen atmosphere or a mixed gas atmosphere of hydrogen and an inert gas;

subsequently subjecting the R—T—M—A—Mg alloy material to dehydrogenating treatment in which hydrogen is forcibly released from the R—T—M—A—Mg alloy material to promote phase transformation by maintaining the R—T—M—A—Mg alloy material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(3) A method of producing a rare earth alloy magnet powder, which has superior magnetic anisotropy and an aggregate of fine recrystallized structure of a $R_2T_{14}M$ type intermetallic compound phase, having the steps of:

subjecting a R—T—M—A—Mg alloy material to hydrogen-occluding treatment in which hydrogen is occluded in the R—T—M—A—Mg alloy material to promote phase transformation by elevating the temperature of the alloy material from room temperature to a predetermined temperature ranging from 500° to 1,000° C. and maintaining the elevated temperature in a hydrogen atmosphere at 1/76 to 5 atm or a mixed gas atmosphere of hydrogen at a partial pressure of 1/76 to 5 atm and an inert gas;

subsequently subjecting the R—T—M—A—Mg alloy material to dehydrogenating treatment in which hydrogen is forcibly released from the alloy material to promote phase transformation by maintaining the R—T—M—A—Mg alloy material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(4) A method of producing a rare earth alloy magnet powder, which has superior magnetic anisotropy and an aggregate of fine recrystallized structure of a $R_2T_{14}M$ type intermetallic compound phase, having the steps of:

elevating the temperature of a R—T—M—A—Mg alloy material from room temperature to 500° C. or maintaining the elevated temperature after temperature elevation in a vacuum or inert gas atmosphere; subjecting a R—T—M—A—Mg alloy material to hydrogen-occluding treatment in which hydrogen is occluded in the R—T—M—A—Mg alloy material to promote phase transformation by elevating the temperature of the R—T—M—A—Mg alloy material from room temperature to a predetermined temperature ranging from 500° to 1,000° C. and maintaining the elevated temperature in a hydrogen atmosphere at 1/76 to 5 atm or a mixed gas atmosphere of hydrogen at a partial pressure of 1/76 to 5 atm and an inert gas;

subsequently subjecting the R—T—M—A—Mg alloy material to dehydrogenating treatment in which hydrogen is forcibly released from the alloy material to promote phase transformation by maintaining the material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(5) A method of producing a rare earth alloy magnet powder, which has superior magnetic anisotropy and an aggregate of fine recrystallized structure of a $R_2T_{14}M$ type intermetallic compound phase, having the steps of:

subjecting to homogenization treatment in which a R—T—M—A—Mg alloy material is maintained at a temperature ranging from 600° to 1.200° C. in a vacuum or Ar gas atmosphere, subjecting the homogenized R—T—M—A—Mg alloy material to hydrogen-occluding treatment in which hydrogen is occluded in the R—T—M—A—Mg alloy material to promote phase transformation by elevating the temperature of the alloy material from room temperature to a predetermined temperature ranging from 500° to 1,000° C. and maintaining the elevated temperature in a hydrogen atmosphere or a mixed gas atmosphere of hydrogen and an inert gas;

subsequently subjecting the R—T—M—A—Mg alloy material to dehydrogenating treatment in which hydrogen is forcibly released from the R—T—M—A—Mg alloy material to promote phase transformation by maintaining the material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(6) A method of producing a rare earth alloy magnet powder, which has superior magnetic anisotropy and an aggregate of fine recrystallized structure of a $R_2T_{14}M$ type intermetallic compound phase, having the steps of:

subjecting a R—T—M—A—Mg alloy material to homogenization treatment in which the temperature is maintained in a range of from 600° to 1.200° C. in a vacuum or Ar gas atmosphere, elevating the temperature of the homogenized R—T—M—A—Mg alloy material from room temperature to 500° C. or maintaining the elevated temperature after temperature elevation in a vacuum or inert gas atmosphere; subjecting the resulting R—T—M—A—Mg alloy material to hydrogen-occluding treatment in which hydrogen is occluded in the R—T—M—A—Mg alloy material to promote phase transformation by elevating the temperature of the R—T—M—A—Mg alloy material from room temperature to a predetermined temperature ranging from 500° to 1,000° C. and maintaining the elevated temperature in a hydrogen atmosphere or a mixed gas atmosphere of hydrogen and an inert gas;

subsequently subjecting the R—T—M—A—Mg alloy material to dehydrogenating treatment in which hydrogen is forcibly released from the R—T—M—A—Mg alloy material to promote phase transformation by maintaining the R—T—M—A—Mg alloy material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(7) A method of producing a rare earth alloy magnet powder, which has superior magnetic anisotropy and an aggregate of fine recrystallized structure of a $R_2T_{14}M$ type intermetallic compound phase, having the steps of:

subjecting a R—T—M—A—Mg alloy material to homogenization treatment in which the R—T—M—A—Mg alloy material is maintained at a temperature ranging from 600° to 1.200° C. in a vacuum or Ar gas atmosphere, subjecting the homogenized R—T—M—A—Mg alloy material to hydrogen-occluding treatment in which hydrogen is occluded in the R—T—M—A—Mg alloy material to promote phase transformation by elevating the temperature of the R—T—M—A—Mg alloy material from room temperature to a predetermined temperature ranging from 500° to 1,000° C. and maintaining the elevated temperature in a hydrogen atmosphere at 1/76 to 5 atm or a mixed gas atmosphere of hydrogen at a partial pressure of 1/76 to 5 atm and an inert gas;

subjecting the R—T—M—A—Mg alloy material to dehydrogenating treatment in which hydrogen is forcibly released from the alloy material to promote phase transformation by maintaining the material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(8) A method of producing a rare earth alloy magnet powder, which has superior magnetic anisotropy and an aggregate of fine recrystallized structure of a $R_2T_{14}M$ type intermetallic compound phase, having the steps of:

subjecting a R—T—M—A—Mg alloy material to homogenization treatment in which the R—T—M—A—Mg alloy material is maintained at a temperature ranging from 600° to 1.200° C. in a vacuum or Ar gas atmosphere, elevating the temperature of the homogenized R—T—M—A—Mg alloy material from room temperature to 500° C. or maintaining the elevated temperature after temperature elevation in a vacuum or inert gas atmosphere; subjecting the homogenized R—T—M—A—Mg alloy material to hydrogen-occluding treatment in which hydrogen is occluded in the R—T—M—A—Mg alloy material to promote phase transformation by elevating the temperature of the R—T—M—A—Mg alloy material from room temperature to a predetermined temperature ranging from 500° to 1,000° C. and maintaining the elevated temperature in a hydrogen atmosphere at 1/76 to 5 atm or a mixed gas atmosphere of hydrogen at a partial pressure of 1/76 to 5 atm and an inert gas;

subjecting the R—T—M—A—Mg alloy material to dehydrogenating treatment in which hydrogen is forcibly released from the alloy material to promote phase transformation by maintaining the material at a predetermined temperature ranging from 500° to 1,000° C. in a vacuum atmosphere of less than 1 Torr, cooling; and crushing the R—T—M—A—Mg alloy material to obtain a rare earth alloy magnet powder.

(9) A method of producing a rare earth alloy magnet powder, which has superior magnetic anisotropy and an aggregate of fine recrystallized structure of a $R_2T_{14}M$ type intermetallic compound phase, in which the R—T—M—A—Mg alloy material according to the above (1), (2), (3), (4), (5), (6), (7), or (8) contains 0.001 to 0.03 atomic % of Mg.

(10) A method of producing a rare earth alloy magnet powder, which has superior magnetic anisotropy and an aggregate of fine recrystallized structure of a $R_2T_{14}M$ type intermetallic compound phase, in which the R—T—M—A—Mg alloy material according to the above (1), (2), (3), (4), (5), (6), (7), or (8) contains 0.001 to 0.03 atomic % of Mg and 0.001 to 1.0 atomic % of A.

A rare earth alloy magnet can be produced by binding a rare earth alloy magnet powder, which has superior magnetic anisotropy and an aggregate of fine recrystallized structure of a $R_2T_{14}M$ type intermetallic compound phase, using an organic binder or a metallic binder or by hot pressing or hot hydrostatic pressing at a temperature ranging from 500° to 900° C. Therefore, the present invention is characterized by the following:

(11) A method of producing a rare earth alloy magnet, in which the rare earth alloy magnet powder, that has superior magnetic anisotropy and an aggregate of fine recrystallized structure of a $R_2T_{14}M$ type intermetallic compound phase and that was obtained according to a producing method described in (1), (2), (3), (4), (5), (6), (7), (8), (9), or (10), is bound using an organic binder or a metallic binder.

(12) A method of producing a rare earth alloy magnet, in which the rare earth alloy magnet powder, that has superior magnetic anisotropy and an aggregate of fine recrystallized structure of a $R_2T_{14}M$ type intermetallic compound phase and that was obtained according to a production method described in (1), (2), (3), (4), (5) , (6), (7), (8), (9), or (10), is rendered to a green compact and subjected to hot pressing or hot hydrostatic pressing at a temperature ranging from 600° to 900° C.

When a R—T—M—A—Mg alloy material prepared by addition of Mg to a conventional R—T—M—A alloy is used as a material and the R—T—M—A—Mg alloy material is subjected to conventional hydrogen-occluding treatment and dehydrogenating treatment, a rare earth alloy magnet powder having superior magnetic anisotropy as compared with conventional powders can be obtained; however, if the Mg content exceeds 0.1 atomic %, the magnetic characteristics of the rare earth alloy magnet powder disadvantageously decreases. Therefore, the preferred amount of Mg contained in the R—T—M—A—Mg alloy material was set to not more than 0.1 atomic %. The more preferred amount of Mg contained in the R—T—M—A—Mg alloy material ranges from 0.001 to 0.03 atomic %, and it is furthermore preferable to set the A content between 0.001 and 1.0 atomic %.

DETAILED DESCRIPTION OF THE PREFERRED EMBODIMENTS

Various preferred embodiments of the methods of the subject invention are set forth in the following examples.

EXAMPLE 1

An alloy having the composition of 12.2 atomic % of Nd, 6.0 atomic % of B, 11.6 atomic % of Co, and 0.5 atomic % of Ga, and the balance Fe, was melted in a high-frequency vacuum melting furnace. Then ingots of R—T—M—A—Mg alloy material each having a composition as shown in Table 1 were prepared by addition of Mg as a Fe—Co—Mg master alloy at the time of casting the thus-obtained molten metal. Moreover, an ingot of R—T—M—A alloy material was prepared by casting the molten metal without addition of Mg. Methods 1 to 8 of the present invention, a comparative method 1, and a conventional method 1 were conducted by subjecting each of the thus-obtained ingots of R—T—M—A—Mg alloy material and the ingot of R—T—M—A alloy material to the following steps: hydrogen-occluding treatment in a hydrogen atmosphere at 1 atm by elevating the temperature of the ingot from room temperature to 850° C. and maintaining the ingot at 850° C. for 1 hour; subsequently dehydrogenating treatment in a vacuum atmosphere of not more than $1\times10^{-1}$ Torr by maintaining the ingot at 850° C. for 1 hour, forcible cooling to room temperature using Ar gas; and crushing to not more than 500 $\mu$m to produce a rare earth alloy magnet powder.

To each of the rare earth alloy magnet powders obtained from the methods 1 to 8 of the present invention, the comparative method 1, and the conventional method 1, 3% by weight of an epoxy resin was added, mixed, and kneaded, the resultant mass was compression-molded in a magnetic field of 20 kOe to prepare a green compact and the green compact was subjected to a thermo-setting treatment at 120° C. for 3 hours in an oven to produce a bonded magnet; the magnetic characteristics of the thus-obtained bonded magnet are shown in Table 1.

TABLE 1

| Sample | | Ingot Composition (Atomic %) Nd | B | Co | Ga | Mg | Fe | Magnetic Characteristics of Bond Magnet Br (kG) | iHc (kOe) | BHmax (MGOe) |
|---|---|---|---|---|---|---|---|---|---|---|
| Method of Present Invention | 1 | 12.2 | 6.0 | 11.6 | 0.5 | 0.0001 | Balance | 8.7 | 11.8 | 17.0 |
| | 2 | | | | | 0.001 | | 8.7 | 12.5 | 17.4 |
| | 3 | | | | | 0.004 | | 8.7 | 12.4 | 17.5 |
| | 4 | | | | | 0.007 | | 8.8 | 12.7 | 17.5 |
| | 5 | | | | | 0.009 | | 8.6 | 12.3 | 17.3 |
| | 6 | | | | | 0.014 | | 8.7 | 12.5 | 17.4 |
| | 7 | | | | | 0.030 | | 8.7 | 12.0 | 17.5 |
| | 8 | | | | | 0.10 | | 8.6 | 11.9 | 17.0 |
| Comparative Method | 1 | | | | | 0.15 | | 8.3 | 12.1 | 16.2 |
| Conventional Method | 1 | | | | | — | | 8.4 | 12.0 | 16.0 |

It is understood from the results shown in Table 1 that the magnetic characteristics of the bonded magnets prepared from rare earth alloy magnet powders obtained by the methods 1 to 8 of the present invention and the comparative method 1, in each of which methods the R—T—M—A—Mg alloy material containing Mg is subjected to hydrogen-occluding treatment and dehydrogenating treatment, are improved as compared with the magnetic characteristics of the bonded magnet prepared by the conventional method 1, in which method the R—T—M—A alloy material not containing Mg is subjected to hydrogen-occluding treatment and dehydrogenating treatment. However, it is apparent that the magnetic characteristics of the bonded magnet prepared from a rare earth alloy magnet powder obtained by the comparative method 1 using the R—T—M—A—Mg alloy material containing 0.15 atomic % of Mg are inferior.

EXAMPLE 2

An alloy the composition of which included 12.8 atomic % of Nd, 20.5 atomic % of Co, 6.0 atomic % of B, 0.2 atomic % of Zr, and 0.5 atomic % of Ga, and the balance being Fe, was melted in a high-frequency vacuum melting furnace and then ingots of R—T—M—A—Mg alloy materials each having a composition as shown in Table 2 were prepared by addition of Mg as a Fe-Mg master alloy at the time of casting the thus-obtained molten metal. Moreover, an ingot of R—T—M—A alloy material was prepared by casting the molten metal without addition of Mg. Methods 9 to 16 of the present invention, a comparative method 2, and a conventional method 2 were conducted by subjecting each of the thus-obtained ingots of R—T—M—A—Mg alloy material and the ingot of R—T—M—A alloy material to the following steps: homogenization treatment in an Ar atmosphere by maintaining the ingot at 1130° C. for 40 hours; hydrogen-occluding treatment in a hydrogen atmosphere at 1 atm by elevating the temperature of the ingot from room temperature to 820° C. and maintaining the ingot at 820° C. for 1 hour; subsequently dehydrogenating treatment in a vacuum atmosphere of not more than $1\times10^{-1}$ Torr by maintaining the ingot at 820° C. for 1 hour, forcible cooling to room temperature using Ar gas; and crushing to not more than 500 $\mu$m to produce a rare earth alloy magnet powder. Each of the thus-obtained rare earth alloy magnet powders was rendered to an anisotropic green compact in a magnetic field, then the anisotropic green compact was set in a hot-press apparatus, hot-pressed at a pressure of 0.5 Ton/cm$^2$ for 10 minutes in a vacuum such that the magnetic field was applied in the pressing direction, rapidly cooled in an Ar atmosphere to produce a hot-press magnet; the magnetic characteristics of the thus-obtained bonded magnets are shown in Table 2.

TABLE 2

| Sample | | Ingot composition (Atomic %) Nd | B | Co | Ga | Zr | Mg | Fe | Treatment condition | Magnetic Characteristics of Hot Press Magnet Br (kG) | iHc (kOe) | BHmax (MGOe) |
|---|---|---|---|---|---|---|---|---|---|---|---|---|
| Method of present Invention | 9 | 12.8 | 6.0 | 0.5 | 20.5 | 0.2 | 0.0001 | Balance | Ar Atmosphere 1130° C. 40 hr | 12.3 | 11.1 | 33.0 |
| | 10 | | | | | | 0.0005 | | | 12.6 | 11.0 | 34.1 |
| | 11 | | | | | | 0.001 | | | 12.8 | 11.4 | 38.4 |
| | 12 | | | | | | 0.003 | | | 12.7 | 11.5 | 37.2 |
| | 13 | | | | | | 0.005 | | | 13.0 | 11.7 | 39.0 |
| | 14 | | | | | | 0.008 | | | 13.1 | 11.6 | 40.5 |
| | 15 | | | | | | 0.021 | | | 12.7 | 11.5 | 35.4 |
| | 16 | | | | | | 0.09 | | | 12.4 | 11.8 | 33.7 |
| Comparative Method | 2 | | | | | | 0.14 | | | 12.3 | 11.1 | 32.2 |
| Conventional Method | 2 | | | | | | — | | | 11.7 | 10.7 | 31.4 |

It is understood from the results shown in Table 2 that the magnetic characteristics of the hot-press magnets prepared from rare earth alloy magnet powders obtained by the methods 9 to 16 of the present invention and the comparative method 2, in each of which the R—T—M—A—Mg alloy material containing Mg is subjected to hydrogen-occluding treatment and dehydrogenating treatment, are improved as compared with the magnetic characteristics of the hot-press magnet prepared from a rare earth alloy magnet powder obtained by the conventional method 1, in which the R—T—M—A alloy material not containing Mg is subjected to hydrogen-occluding treatment and dehydrogenating treatment. However, it is apparent that the magnetic characteristics of the hot-press magnet prepared by the comparative method 2 using the R—T—M—A—Mg alloy material containing 0.14 atomic % of Mg are significantly inferior.

EXAMPLE 3

Ingots a to j each having a composition as shown in Table 3 were prepared by melting in an alumina crucible using a high-frequency vacuum melting furnace and casting. Moreover, ingots A to J each having a composition as shown in Table 4 were prepared such that each of the alloys having a composition as shown in Table 3 was melted in a MgO crucible using a high-frequency vacuum melting furnace, the resulting molten metal was allowed to contain Mg by adjusting the tapping temperature and holding time of the tapping temperature and then cast. Table 3

TABLE 3

| Sample | Composition (atomic %) |
|---|---|
| Ingot | |
| a | Nd: 12.3%, Dy: 0.4%, Co: 17.0%, B: 6.0%, Zr: 0.2%, Fe: bal |
| b | Nd: 12.5%, Pr: 0.5%, Co: 11.5%, B: 6.5%, Zr: 0.1%, Fe: bal |
| c | Nd: 12.4%, B: 6.0%, Ga: 0.6%, Fe: bal |
| d | Nd: 12.5%, Co: 22.8%, B: 7.0%, Zr: 0.2%, Ga: 0.5, Fe: bal |
| e | Nd: 12.4%, Co: 11.6%, B: 6.0%, Hf: 0.2%, Fe: bal |
| f | Nd: 12.5%, La: 0.3%, Co: 18.5%, B: 5.5%, Zr: 0.1%, Fe: bal |
| g | Nd: 12.4%, Co: 11.7%, B: 6.0%, Zr: 0.3%, Al: 2.0%, Fe: bal |

TABLE 3-continued

| Sample | Composition (atomic %) |
|---|---|
| h | Nd: 12.5%, B: 6.5%, Nb: 0.5%, Al: 0.7%, V: 0.2%, Fe: bal |
| i | Nd: 6.6%, Pr: 6.5%, Co: 17.5%, B: 7.0%, Ta: 0.4%, Si: 0.1%, Fe: bal |
| j | Nd: 12.4%, Co: 11.5%, B: 7.0%, Ga: 0.4%, Si: 0.3%, Fe: bal |

TABLE 4

| Sample | Composition (atomic %) |
|---|---|
| Ingot | |
| A | Nd: 11.9%, Dy: 0.4%, Co: 17.0%, B: 6.0%, Zr: 0.2%, Mg: 0.003%, Fe: bal |
| B | Nd: 12.1%, Pr: 0.5%, Co: 11.5%, B: 6.5%, Zr: 0.1%, Mg: 0.002%, Fe: bal |
| C | Nd: 12.2%, B: 6.0%, Ga: 0.6%, Mg: 0.001%, Fe: bal |
| D | Nd: 12.5%, Co: 22.8%, B: 7.0%, Zr: 0.2%, Ga: 0.5, Mg: 0.004%, Fe: bal |
| E | Nd: 12.4%, Co: 11.6%, B: 6.0%, Hf: 0.2%, Mg: 0.006%, Fe: bal |
| F | Nd: 12.3%, La: 0.3%, Co: 18.5%, B: 5.5%, Zr: 0.1%, Mg: 0.005%, Fe: bal |
| G | Nd: 12.4%, Co: 11.7%, B: 6.0%, Zr: 0.3%, Al: 2.0%, Mg: 0.008%, Fe: bal |
| H | Nd: 12.3%, B: 6.5%, Nb: 0.5%, Al: 0.7%, V: 0.2%, Mg: 0.009%, Fe: bal |
| I | Nd: 6.6%, Pr: 6.5%, Co: 17.5%, B: 7.0%, Ta: 0.4%, Si: 0.1%, V: 0.1%, Mg: 0.009%, Fe: bal |
| J | Nd: 12.2%, Co: 11.5%, B: 7.0%, Ga: 0.4%, Si: 0.3%, Mg: 0.015%, Fe: bal |

Conventional methods 17 to 26 and methods 17 to 26 of the present invention were respectively conducted by subjecting the ingots a to j each having a composition not containing Mg as shown in Table 3 and the ingots A to J each having a composition containing Mg as shown in Table 4 to the following steps: homogenization treatment conducted in an Ar atmosphere according to the conditions shown in Tables 5 and 6; hydrogen-occluding treatment in a hydrogen atmosphere at 1/76 to 5 atm or a mixed gas atmosphere of hydrogen at a partial pressure of 1/76 to 5 atm and an inert gas by elevating the temperature of the ingot from room temperature to the temperature shown in Tables 5 and 6 and maintaining the ingot at the elevated temperature for the time shown in Tables 5 and 6; dehydrogenating treatment conducted according to the conditions shown in Tables 5 and 6, forcible cooling to room temperature using Ar gas; and crushing to not more than 500 μm to produce rare earth alloy magnet powders.

TABLE 5

| Sample | | Ingot Type | Homogenization Condition Temp. (°C.) | Homogenization Condition Holding Time (h) | Hydrogen-Occluding Temp. (°C.) | Hydrogen-Occluding Hydrogen Pressure or Hydrogen Partial Pressure (atm) | Hydrogen-Occluding Holding Time (hr) | Dehydrogenation Condition Temp. (°C.) | Dehydrogenation Condition Vacuum (Torr) | Dehydrogenation Condition Holding Time (hr) |
|---|---|---|---|---|---|---|---|---|---|---|
| Method of Present Invention | 17 | A | 1100 | 50 | 500 | 5.0 | 5.0 | 650 | 0.5 | 5.0 |
| Conventional Method | 17 | a | | | | | | | | |
| Method of Present Invention | 18 | B | 1150 | 20 | 850 | 1.0 | 1.0 | 850 | 0.0006 | 1.0 |
| Conventional Method | 18 | b | | | | | | | | |
| Method of Present Invention | 19 | C | 1120 | 30 | 600 | 2.0 | 2.0 | 950 | 0.4 | 0.5 |
| Conventional Method | 19 | c | | | | | | | | |
| Method of Present Invention | 20 | D | 1080 | 50 | 900 | 0.014 | 2.0 | 700 | 0.007 | 2.0 |
| Conventional Method | 20 | d | | | | | | | | |
| Method of Present Invention | 21 | E | 1110 | 40 | 700 | 2.5 | 4.0 | 500 | 0.08 | 20 |
| Conventional Method | 21 | e | | | | | | | | |

TABLE 6

| Sample | | Ingot Type | Homogenization Condition Temp. (°C.) | Homogenization Condition Holding Time (h) | Hydrogen-Occulding Temp. (°C.) | Hydrogen-Occulding Hydrogen Pressure or Hydrogen Partial Pressure (atm) | Hydrogen-Occulding Holding Time (hr) | Dehydrogenation Condition Temp. (°C.) | Dehydrogenation Condition Vacuum (Torr) | Dehydrogenation Condition Holding Time (hr) |
|---|---|---|---|---|---|---|---|---|---|---|
| Method of Present Invention | 22 | F | 1140 | 50 | 850 | 0.8 | 1.0 | 850 | 0.003 | 0.5 |
| Conventional Method | 22 | f | | | | | | | | |
| Method of Present Invention | 23 | G | 1160 | 5 | 850 | 0.9 | 1.0 | 850 | 0.02 | 1.0 |
| Conventional Method | 23 | g | | | | | | | | |
| Method of Present Invention | 24 | H | 1130 | 30 | 700 | 1.2 | 3.0 | 800 | 0.1 | 2.0 |
| Conventional Method | 24 | h | | | | | | | | |
| Method of Present Invention | 25 | I | 900 | 80 | 900 | 3.0 | 2.0 | 900 | 0.9 | 1.0 |
| Conventional Method | 25 | i | | | | | | | | |

TABLE 6-continued

| Sample | | Ingot Type | Homogenization Condition Temp. (°C.) | Homogenization Condition Holding Time (h) | Hydrogen-Occulding Temp. (°C.) | Hydrogen-Occulding Hydrogen Pressure or Hydrogen Partial Pressure (atm) | Hydrogen-Occulding Holding Time (hr) | Dehydrogenation Condition Temp. (°C.) | Dehydrogenation Condition Vacuum (Torr) | Dehydrogenation Condition Holding Time (hr) |
|---|---|---|---|---|---|---|---|---|---|---|
| Method of Present Invention | 26 | J | 1000 | 50 | 1000 | 5.0 | 3.0 | 1000 | 0.01 | 0.2 |
| Conventional Method | 26 | j | | | | | | | | |

To each of the rare earth alloy magnet powders prepared from rare earth alloy magnet powders obtained by the methods 17 to 26 of the present invention and the conventional methods 17 to 26, 2.5% by weight of an epoxy resin was added, mixed, and kneaded, then the resultant was compression-molded in a magnetic field of 20 kOe to prepare a green compact, and the green compact was subjected to thermo-setting treatment at 120° C. for 2 hours in an oven to produce a bonded magnet; the magnetic characteristics of the thus-obtained bonded magnets are shown in Table 7.

TABLE 7

| Method | | Sample | Magnetic characteristics of Bonded Magnet Br (kG) | iHc (kOe) | BHmax (MGOe) |
|---|---|---|---|---|---|
| Method of Present Invention | 17 | A | 8.7 | 12.0 | 18.0 |
| Conventional Method | 17 | a | 8.3 | 12.0 | 14.5 |
| Method of Present Invention | 18 | B | 9.2 | 12.7 | 19.6 |
| Conventional Method | 18 | b | 8.4 | 12.7 | 16.0 |
| Method of Present Invention | 19 | C | 9.3 | 12.8 | 19.3 |
| Conventional Method | 19 | c | 8.4 | 12.5 | 16.0 |
| Method of Present Invention | 20 | D | 8.8 | 12.9 | 17.9 |
| Conventional Method | 20 | d | 8.5 | 12.5 | 16.2 |
| Method of Present Invention | 21 | E | 9.2 | 13.0 | 19.1 |
| Conventional Method | 21 | e | 8.5 | 12.6 | 15.8 |
| Method of Present Invention | 22 | F | 9.1 | 12.5 | 18.8 |
| Conventional Method | 22 | f | 8.5 | 12.5 | 15.8 |
| Method of Present Invention | 23 | G | 10.6 | 12.5 | 21.5 |
| Conventional Method | 23 | g | 8.7 | 12.5 | 18.3 |
| Method of Present Invention | 24 | H | 9.2 | 13.3 | 19.4 |
| Conventional Method | 24 | h | 8.2 | 13.0 | 15.7 |
| Method of Present Invention | 25 | I | 10.0 | 13.2 | 20.1 |
| Conventional Method | 25 | i | 8.7 | 13.0 | 17.2 |
| Method of Present Invention | 26 | J | 8.7 | 12.4 | 17.4 |
| Conventional Method | 26 | j | 8.5 | 12.3 | 14.9 |

It is understood from the results shown in Tables 5 to 7 that when comparing the method 17 of the present invention with the conventional method 17, the magnetic characteristics of the bonded magnet prepared from a rare earth alloy magnet powder obtained by the method 17 of the present invention, in which methods a R—T—M—A—Mg alloy material containing Mg is subjected to hydrogen-occluding treatment and dehydrogenating treatment, are superior as compared with the magnetic characteristics of the bonded magnet prepared from a rare earth alloy magnet powder obtained by the conventional method 17, in which method the R—T—M—A alloy material not containing Mg is subjected to hydrogen-occluding treatment and dehydrogenating treatment.

Similarly, it is understood from comparison between the methods 18 to 26 of the present invention and the conventional methods 18 to 26 that the magnetic characteristics of the bonded magnets prepared from rare earth alloy magnet powders obtained by the methods 18 to 26 of the present invention, in each of which methods the R—T—M—A—Mg alloy material containing Mg is subjected to hydrogen-occluding treatment and dehydrogenating treatment, are superior as compared with the magnetic characteristics of the bonded magnets prepared from rare earth alloy magnet powders obtained by the conventional methods 18 to 26, in each of which methods R—T—M—A alloy material not containing Mg is subjected to hydrogen-occluding treatment and dehydrogenating treatment.

EXAMPLE 4

Methods 27 to 36 of the present invention were carried out by subjecting the homogenized ingots A to J prepared in Example 3 to the following steps: hydrogen-occluding treatment conducted under exactly the same conditions as in Example 3, except that the temperature of each ingot was elevated in a vacuum or inert gas atmosphere shown in Table 8 from room temperature to the temperature shown in Table 8 and maintained at the elevated temperature for the time shown in Table 8; dehydrogenating treatment; forcible cooling to room temperature using Ar gas; and crushing to not more than 500 $\mu$m to produce rare earth alloy magnet powders.

To each of the rare earth alloy magnet powders obtained from the methods 27 to 36 of the present invention, 2.5% by weight of an epoxy resin was added, mixed, and kneaded, then the resultant was compression-molded in a magnetic field of 20 kOe to prepare a green compact, then the green compact was subjected to thermo-setting treatment at 120° C. for 2 hours in an oven to produce a bonded magnet; the magnetic characteristics of the thus-obtained bonded magnets are shown in Table 8.

TABLE 8

| Sample | | Type of Treated Ingot | Conditions of Temperature Elevation and Holding: Atmosphere | Temp. elevating Rate (°C./min.) | Temp. Elevation (°C.) | Holding Time (min.) | Magnetic characteristics of Bond Magnet: Br (kG) | iHc (dOe) | BHmax (MGOe) |
|---|---|---|---|---|---|---|---|---|---|
| Method of Present Invention | 27 | A | Vacuum | 30 | 200 | 60 | 8.8 | 12.5 | 18.5 |
| | 28 | B | Ar | 30 | 100 | 60 | 9.4 | 12.8 | 20.3 |
| | 29 | C | Vacuum | 5 | 500 | 100 | 9.6 | 12.9 | 20.1 |
| | 30 | D | Vacuum | 30 | 300 | 30 | 8.9 | 12.3 | 18.8 |
| | 31 | E | Ar | 10 | 300 | 120 | 9.3 | 12.7 | 19.9 |
| | 32 | F | Ar | 5 | 200 | 60 | 9.2 | 12.8 | 19.5 |
| | 33 | G | Ar | 20 | 50 | 120 | 10.0 | 13.0 | 22.3 |
| | 34 | H | Vacuum | 35 | 150 | 180 | 10.0 | 12.8 | 20.0 |
| | 35 | I | Vacuum | 20 | 100 | 60 | 10.1 | 13.3 | 21.0 |
| | 36 | J | Vacuum | 1 | 200 | 60 | 8.7 | 12.5 | 17.9 |

It is understood from comparison between the magnetic characteristics of the bonded magnets using the rare earth alloy magnet powders obtained by the methods 27 to 36 of the present invention and the magnetic characteristics of the bonded magnets using the rare earth alloy magnet powders obtained by the methods 17 to 26 of the present invention shown in Table 7 that, even though the bonded magnets were prepared using the homogenized ingots A to J containing Mg, which ingots had been subjected to the same homogenization treatment, their magnetic characteristics are improved by elevating the temperature of the magnets and maintaining the elevated temperature in a vacuum or inert gas atmosphere before the hydrogen-occluding treatment.

As described above, according to the present invention, a rare earth alloy magnet powder having more superior magnetic anisotropy as compared with conventional ones can be produced by subjecting a R—T—M—A—Mg alloy material containing Mg to hydrogen-occluding treatment and a dehydrogenizing treatment, thus the present invention has excellent industrial application.

It is claimed:

1. A method of producing a rare earth alloy magnet powder having superior magnetic anisotropy and an aggregate of fine recrystallized structure of a $R_2T_{14}M$ intermetallic compound phase, the method comprising the steps of:

subjecting a R—T—M—A—Mg alloy material to hydrogen-occluding treatment in which hydrogen is occluded in said R—T—M—A—Mg alloy material to promote phase transformation by elevating the temperature of the material from room temperature to a temperature ranging from 500° to 1,000° C. and maintaining said temperature under a hydrogen atmosphere or a mixed gas atmosphere of hydrogen and an inert gas;

subsequently subjecting said R—T—M—A—Mg alloy material to dehydrogenating treatment in which hydrogen is forcibly released from said R—T—M—A—Mg alloy material to promote phase transformation by maintaining said R—T—M—A—Mg alloy material at a temperature ranging from 500° to 1,000° C. in a vacuum atmosphere of less than 1 Torr;

cooling the material; and crushing the material to a powder;

where, in said R—T—M—A—Mg alloy material:

R is at least one rare earth element inclusive of Y;

T is at least Fe selected from the group consisting of Fe, Co and Ni;

M is at least B selected from the group consisting of B and C;

A is 0.001 to 5.0 atomic % of one or more elements selected from the group consisting of Si, Ga, Zr, Nb, Mo, Hf, Ta, W, Al, Ti, and V; and said R—T—M—A—Mg alloy material contains from 0.001 to 0.03 atomic % of Mg.

2. A method of producing a rare earth alloy magnet powder as set forth in claim 1, wherein said R—T—M—A—Mg alloy material, prior to being subjected to said hydrogen-occluding treatment, is subjected to a homogenization treatment in which said R—T—M—A—Mg alloy material is maintained at a temperature ranging from 600° to 1200° C. in a vacuum or Ar gas atmosphere.

3. A method of producing a rare earth alloy magnet powder having superior magnetic anisotropy and an aggregate of fine recrystallized structure of a $R_2T_{14}M$ intermetallic compound phase, comprising the steps of:

elevating a R—T—M—A—Mg alloy material from room temperature to an elevated temperature in the range of 50020 C. to 1000° C. under a hydrogen atmosphere or a mixed gas atmosphere of hydrogen and an inert gas.

subjecting said R—T—M—A—Mg alloy material to hydrogen-occluding treatment in which hydrogen is occluded in said R—T—M—A—Mg alloy material to promote phase transformation by maintaining said alloy material at said elevated temperature under a hydrogen atmosphere or a mixed gas atmosphere of hydrogen and an inert gas;

subsequently subjecting said R—T—M—A—Mg alloy material to dehydrogenating treatment in which hydrogen is forcibly released from said R—T—M—A—Mg alloy material to promote phase transformation by maintaining said R—T—M—A—Mg alloy material at a temperature ranging from 500° to 1,000° C. in a vacuum atmosphere of less than 1 torr, cooling; and crushing, where, in said R—T—M—A—Mg alloy material:

R is at least one rare earth element inclusive of Y;

T is at least Fe selected from the group consisting of Fe, Co and Ni;

M is at least B selected from the group consisting of B and C;

A is 0.001 to 5.0 atomic % of one or more elements selected from the group consisting of Si, Ga, Zr, Nb, Mo, Hf, Ta, W, Al, Ti, and V; and said R—T—M—A—Mg alloy material contains from 0.001 to 0.03 atomic % of Mg.

4. A method of producing a rare earth alloy magnet powder as set forth in claim 3, wherein said R—T—M—A—Mg alloy material, prior to being subjected to said hydrogen-occluding treatment, is subjected to a homogenization treatment in which said R—T—M—A—Mg alloy material is maintained at a temperature ranging from 600° to 1200° C. in a vacuum or Ar gas atmosphere.

5. A method of producing a rare earth alloy magnet powder having superior magnetic anisotropy and an aggregate of fine recrystallized structure of a $R_2T_{14}M$ intermetallic compound phase, comprising the successive steps of:

subjecting a R—T—M—A—Mg alloy material to hydrogen-occluding treatment in which hydrogen is occluded in said R—T—M—A—Mg alloy material to promote phase transformation by elevating the temperature from room temperature to a temperature ranging from 500° to 1,000° C. and maintaining said temperature in a hydrogen atmosphere at 1/76 to 5 atm or a mixed gas atmosphere of hydrogen at a partial pressure of 1/76to 5 atm and an inert gas;

subsequently subjecting said R—T—M—A—Mg alloy material to dehydrogenating treatment in which hydrogen is forcibly released from said R—T—M—A—Mg alloy material to promote phase transformation by maintaining said R—T—M—A—Mg alloy material at a temperature ranging from 500° to 1000° C. in a vacuum atmosphere of less than 1 Torr; cooling; and crushing, where, in said R—T—M—A—Mg alloy material:

R is at least one rare earth element inclusive of Y;

T is at least Fe selected from the group consisting of Fe, Co and Ni;

M is at least B selected from the group consisting of B and C;

A is 0.001 to 5.0 atomic % of one or more elements selected from the group consisting of Si, Ga, Zr, Nb, Mo, Hf, Ta, W, Al, Ti, and V; and said R—T—M—A—Mg alloy material contains from 0.001 to 0.03 atomic % of Mg.

6. A method of producing a rare earth alloy magnet powder as set forth in claim 5, wherein said R—T—M—A—Mg alloy material, prior to being subjected to said hydrogen-occluding treatment, is subjected to a homogenization treatment in which said R—T—M—A—Mg alloy material is maintained at a temperature ranging from 600° to 1200° C. in a vacuum or Ar gas atmosphere.

7. A method of producing a rare earth alloy magnet powder having superior magnetic anisotropy and an aggregate of fine recrystallized structure of a $R_2T_{14}M$ type intermetallic compound phase, comprising the steps of:

elevating a R—T—M—A—Mg alloy material from room temperature to a elevated temperature up to 500° C. and maintaining said alloy material at the elevated temperature in a vacuum or inert gas atmosphere;

subjecting said R—T—M—A—Mg alloy material to hydrogen-occluding treatment in which hydrogen is occluded in said R—T—M—A—Mg alloy material to promote phase transformation by elevating the temperature from room temperature to a temperature ranging from 500° to 1,000° C. and maintaining said temperature in a hydrogen atmosphere at 1/76 to 5 atm or a mixed gas atmosphere of hydrogen at a partial pressure of 1/76to 5 atm and an inert gas;

subsequently subjecting said R—T—M—A—Mg alloy material to dehydrogenating treatment in which hydrogen is forcibly released from said R—T—M—A—Mg alloy material to promote phase transformation by maintaining said R—T—M—A—Mg alloy material at a temperature ranging from 500° to 1,000° C. in a vacuum atmosphere of less than 1 Torr; cooling; and crushing, where, in said R—T—M—A—Mg alloy material:

R is at least one rare earth element inclusive of Y;

T is at least Fe selected from the group consisting of Fe, Co and Ni;

M is at least B selected from the group consisting of B and C;

A is 0.001 to 5.0 atomic % of one or more elements selected from the group consisting of Si, Ga, Zr, Nb, Mo, Hf, Ta, W, Al, Ti, and V; and said R—T—M—A—Mg alloy material contains from 0.001 to 0.03 atomic % of Mg.

8. A method of producing a rare earth alloy magnet powder as set forth in claim 7, wherein said R—T—M—A—Mg alloy material, prior to being subjected to said hydrogen-occluding treatment, is subjected to a homogenization treatment in which said R—T—M—A—Mg alloy material is maintained at a temperature ranging from 600° to 1200° C. in a vacuum or Ar gas atmosphere.

9. A method of producing a rare earth alloy magnet powder as set forth in any one of claims 1–8, wherein said R—T—M—A—Mg alloy material comprises 0.001 to 1.0 atomic % of A.

10. A method of producing a rare earth alloy magnet, wherein a rare earth alloy magnet powder which is produced by a method as set forth in any one of claims 1–8 is bound together with an organic binder or a metallic binder.

11. A method of producing a rare earth alloy magnet, wherein a rare earth alloy magnet powder which is produced by a method as set forth in any one of claims 1–8 is formed into a green compact and subjected to hot pressing or hot hydrostatic pressing at a temperature ranging from 600° to 900° C.

* * * * *